US005425863A

United States Patent [19]

Chiti

[11] Patent Number: 5,425,863

[45] Date of Patent: Jun. 20, 1995

[54] ELECTROLYSIS CELL FOR THE PRODUCTION OF A GAS

[75] Inventor: Luciano Chiti, Rosignano-Solvay, Italy

[73] Assignee: Solvay S.A., Brussels, Belgium

[21] Appl. No.: 208,186

[22] Filed: Mar. 10, 1994

Related U.S. Application Data

[63] Continuation of Ser. No. 959,141, Oct. 9, 1992, abandoned.

[30] Foreign Application Priority Data

Oct. 23, 1991 [IT] Italy ..... MI91A2813

[51] Int. Cl.[6] ..... C02F 1/461

[52] U.S. Cl. ..... 204/229; 204/237; 204/257; 204/258; 204/269; 204/270; 204/275; 204/278

[58] Field of Search ..... 204/229, 237, 257, 258, 204/269, 270, 275, 278

[56] References Cited

U.S. PATENT DOCUMENTS

| | | | |
|---|---|---|---|
| 1,855,497 | 5/1928 | Stuart | 204/296 |
| 4,126,588 | 11/1978 | Ukihashi et al. | 521/31 |
| 4,250,126 | 2/1981 | Yates | 261/70 |
| 4,329,215 | 5/1982 | Scoville | 204/229 |
| 4,411,759 | 10/1983 | Olivier | 204/260 |

FOREIGN PATENT DOCUMENTS

| | | |
|---|---|---|
| 53808 | 6/1982 | European Pat. Off. . |
| 0075401 | 3/1983 | European Pat. Off. . |
| 0007674 | 6/1985 | European Pat. Off. . |
| 0412600 | 2/1991 | European Pat. Off. . |
| 0435385 | 7/1991 | European Pat. Off. . |
| 336805 | 4/1959 | Switzerland . |
| 1402920 | 8/1975 | United Kingdom . |
| 1497748 | 1/1978 | United Kingdom . |
| 1497749 | 1/1978 | United Kingdom . |
| 1518387 | 7/1978 | United Kingdom . |
| 1522877 | 8/1978 | United Kingdom . |

*Primary Examiner*—John Niebling
*Assistant Examiner*—Arun S. Phasge
*Attorney, Agent, or Firm*—Emmanuel J. Lobato

[57] ABSTRACT

Electrolysis cell for the production of a gas, comprising at least two electrolysis chambers, respectively anodic (2) and cathodic (3), one at least of which is in communication, at its lower part, with an electrolyte entry pipe (5) and, at its upper part, with an electrolyte degassing chamber (7) sited above it and provided with a gas discharge opening (8) and with an electrolyte discharge opening (16), an electrolyte recycling pipe (10) connecting the degassing chamber (7) to the entry pipe (5) and including a valve (11) which is open or closed according to whether the pressure downstream (B) of the valve (11) is less than or greater than the pressure upstream (A) of the valve.

12 Claims, 4 Drawing Sheets

ELECTROLYSIS CELL FOR THE PRODUCTION OF A GAS

This is a continuation of application Ser. No. 07/959,141, filed Oct. 9, 1992 now abandoned.

The present invention relates to an electrolysis cell in which a gas is produced.

It more particularly relates to an electrolysis cell of the type comprising at least two electrolysis, respectively anodic and cathodic, chambers, one at least of which is in communication, at its lower part, with an electrolyte entry pipe and, at its upper part, with an electrolyte degassing chamber sited above it.

Art electrolysis cell of this type is described in the Patent Application EP-A 0,412,600 (Solvay & Cie), where it is used for the manufacture of chlorine by electrolysis of an aqueous alkali metal chloride solution, for example sodium chloride. To this end, it comprises a membrane which is selectively permeable to cations (for example a membrane made of perfluorinated polymer comprising functional groups derived from carboxylic or sulphonic acid) which separates the anodic chamber from the cathodic chamber. During operation of the cell, an aqueous sodium chloride solution is introduced continuously into the anodic chamber via the abovementioned entry pipe and chlorine is produced at the anode under the effect of the electrolysis current. The chlorine generated at the anode ensures, via a gas lift, a natural upward movement of the electrolyte in the anodic chamber and an emulsion of chlorine in a dilute aqueous sodium chloride solution is collected in the degassing chamber which is sited above the anodic chamber. A separation is carried out in this chamber of the chlorine and the dilute sodium chloride solution which are collected separately.

The monopolar electrolysis cells of the type described above generally comprise several anodic chambers alternating with cathodic chambers and it is desirable that the composition of the electrolyte in the anodic (or cathodic) chambers be uniform. Moreover, it is known that an untimely and unforeseen stoppage in the electrical supply to the cell results in immediate ceasing of chlorine generation and, consequently, of the abovementioned gas lift. There is then a risk of the available chlorine present in the anolyte entering the cathodic chamber and there forming, by reaction with the sodium hydroxide solution which is found therein, sodium hypochlorite which is capable of damaging the cathode.

The invention aims at improving the known electrolysis cell described above by making the composition of the electrolyte in the electrolysis chambers uniform and minimising the quantity of available chlorine which is capable of passing through the membrane and entering the cathodic chamber in the event of a stoppage in the electrical supply to the cell.

To this end, the invention relates to an electrolysis cell for the production of a gas, comprising at least two electrolysis chambers, respectively anodic and cathodic, one at least of which is in communication, at its lower part, with an electrolyte entry pipe and, at its upper part, with an electrolyte degassing chamber sited above it and provided with a gas discharge opening and with an electrolyte discharge opening; according to the invention, a electrolyte recycling pipe connects the degassing chamber to the entry pipe and includes a valve which is open or closed according to whether the pressure downstream of the valve is less than or greater than the pressure upstream of the valve.

The upper part and lower part of the electrolysis chamber are meant to denote the zones of the latter which are respectively situated above and below the mid-point of its height. In practice, the upper part is the upper third of the chamber and the lower part is the lower third. The expressions "upstream" and "downstream" are defined with respect to the direction of circulation in the recycling pipe, from the degassing chamber towards the electrolyte entry pipe.

In the cell according to the invention, the electrolyte entry pipe is used for introducing fresh electrolyte into the electrolysis chamber. The degassing chamber situated above the electrolysis chamber is well known in the art and is used to recover the emulsion produced in the electrolysis chamber and to separate the gas and a dilute electrolyte from it. The gas discharge opening is generally situated in the upper part of the degassing chamber. The recycling pipe connects the degassing chamber to the electrolyte entry pipe. It emerges into the lower part of the degassing chamber and has the function of recycling a fraction of the electrolyte released in the degassing chamber into the electrolysis chamber, the balance being discharged via the abovementioned electrolyte discharge opening. This opening is situated at a level intermediate between that of the gas discharge opening and that where the recycling pipe emerges. The expressions "upper part" and "lower part" of the degassing chamber have the definition given above with respect to the electrolysis chamber.

The valve in the recycling pipe has the function of enabling the electrolyte to circulate in the recycling pipe during normal operation of the cell and of immediately shutting off this pipe in the event of a stoppage in the electrical supply to the cell. This shutting of the valve has the result of causing an immediate discharge of the electrolyte contained in the electrolysis chamber by sweeping with a stream of fresh electrolyte coming from the feed pipe. In order to carry out the duty stated above, the valve is designed so as to be operated automatically under the effect of the variations in pressure in the recycling pipe upstream and downstream of the said valve. By definition, the upstream is the region of the recycling pipe which is situated between the degassing chamber and the valve and immediately adjacent to the latter, and the downstream is the region of this pipe which is found between the electrolyte entry pipe and the valve and immediately adjacent to the latter. More particularly, according to the invention, the valve is designed such that it is open when the downstream pressure is less than the upstream pressure and such that it is closed when the downstream pressure is greater than the upstream pressure. Valves which can be used in the cell according to the invention are well known in the art. Examples of such valves comprise oscillating non-return flap valves, lift valves and float valves.

The invention is particularly applicable to electrolysis cells for the production of chlorine, in which the anodic chamber is separated from the cathodic chamber by an ion separator. The ion separator used in this embodiment of the invention is a sheet placed between the electrolysis chambers and made of a material capable of being crossed by an ion stream during operation of the cell. It can equally be a diaphragm which is permeable to aqueous electrolytes or a membrane with selective permeability.

Examples of diaphragms which can be used in the cell according to the invention are diaphragms made of asbestos, such as those described in the Patent U.S. Pat. No. 1,855,497 (Stuart) and diaphragms made of organic polymers, such as those described in the Patent Application EP-A-7,674 (Solvay & Cie).

A membrane with selective permeability means a thin nonporous membrane comprising an ion exchange substance. The choice of the material which constitutes the membrane and of the ion exchange substance will depend on the nature of the electrolytes which are subjected to electrolysis and on the products which are sought to be obtained. As a general rule, the membrane material is chosen from those which are capable of withstanding the heat and chemical conditions which normally prevail in the cell during electrolysis, the ion exchange substance being chosen from anion exchange substances or cation exchange substances as a function of the electrolysis operations for which the cell is intended. For example, in the case of a cell intended for electrolysis of aqueous sodium chloride solutions for the production of chlorine, hydrogen and aqueous sodium hydroxide solutions, membranes which are highly suitable are cationic membranes made of fluorinated, preferably perfluorinated, polymer containing cationic functional groups derived from sulphonic acids, carboxylic acids or phosphonic acids or mixtures of such functional groups. Examples of membranes of this type are those described in the Patents GB-A-1,497,748 and GB-A-1,497,749 (Asahi Kasei Kogyo K.K.), GB-A-1,518,387, GB-A-1,522,877 and U.S. Pat. No. 4,126,588 (Asahi Glass Company Ltd) and GB-A-1,402,920 (Diamond Shamrock Corp.). Membranes which are particularly suited to this application of the cell according to the invention are those known under the names "Nafion" (Du Pont de Nemours & Co) and "Flemion" (Asahi Glass Company Ltd).

In this embodiment of the invention, the anodic chamber is fed with a sodium chloride brine and the cathodic chamber is fed with water or a dilute alkali metal hydroxide solution. It is recommended that the electrolysis chamber which is connected to the degassing chamber and to the feed pipe should be the anodic chamber. In this case, closure of the valve of the recycling circuit (caused by an interruption in the electrical supply to the cell) has the effect of replacing the anolyte with the feed brine in the anodic chamber. As a variant, the cell may comprise a second degassing chamber which is in communication, on the one hand, with the upper part of the cathodic chamber and, on the other hand, with the pipe which is used for allowing water or dilute aqueous alkali metal hydroxide solution into the cathodic chamber. In this variant, the connection between the degassing chamber and the entry pipe of the cathodic chamber is, in accordance with the invention, a recycling pipe comprising a valve which is open or closed according to whether the pressure downstream of the valve is less than or greater than the pressure upstream of the valve. Thus, in the event of interruption in the electrical supply to the cell, the valve automatically closes and the cathodic chamber is immediately swept with water or a dilute aqueous sodium hydroxide solution coming from the entry pipe.

The cell according to the invention may comprise a single anodic chamber and a single cathodic chamber, or a plurality of alternating anodic and cathodic chambers. To this end, according to a particular embodiment of the invention, the cell comprises several anodic chambers alternating with cathodic chambers from which they are isolated by ionic separators, the anodic (or cathodic) chambers being connected in parallel to the degassing chamber and to the electrolyte feed pipe.

The cell according to the invention is particularly advantageously applied to the production of chlorine and aqueous alkali metal hydroxide solutions, for example sodium hydroxide.

BRIEF DESCRIPTION OF DRAWINGS

Characteristics and details of the invention will emerge from the following description of the appended drawings.

In these figures, the same reference notations denote identical components.

Figure 1:
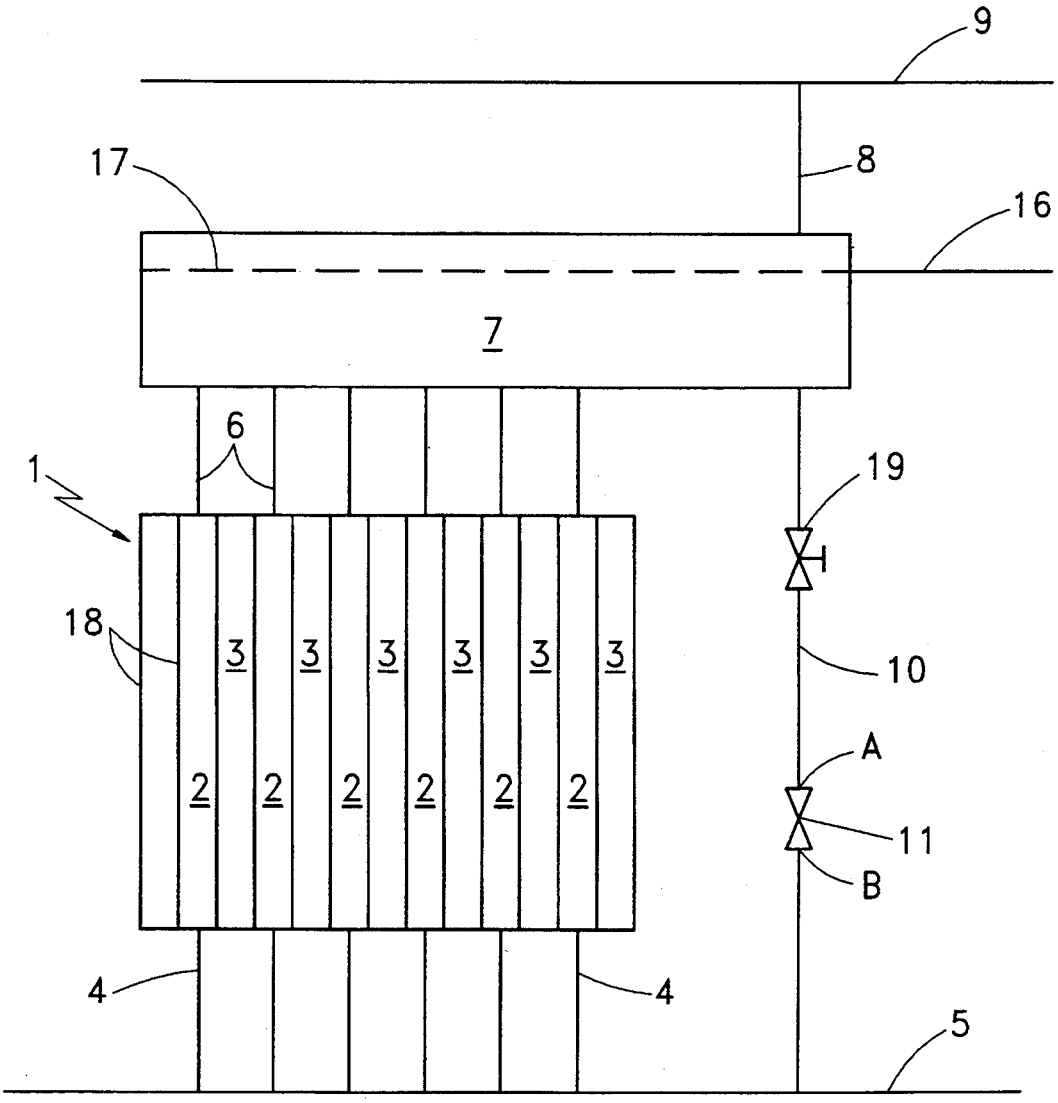
FIG. 1 is a flow sheet of the cell according to the invention in longitudinal elevation.

In FIG. 1, the reference notation 1 denotes an electrolysis cell of the filter press type, intended for the manufacture of chlorine and aqueous sodium hydroxide solutions by electrolysis of aqueous sodium chloride solutions. The cell 1 comprises a series of anodic electrolysis chambers 2, alternating with cathodic electrolysis chambers 3. Membranes 18 which are selectively permeable to cations separate the anodic chambers 2 from the cathodic chambers 3. The anodic chambers 2 contain anodes connected to the positive terminal of a continuous current source and the cathodic chambers 2 contain cathodes which are connected to the negative terminal of the current source. The anodes, the cathodes and the current source are not represented in the drawings.

Pipework 4 connects the lower part of the anodic chambers 2 to an entry pipe 5 for an aqueous sodium chloride solution. Other pipework 6 connects the upper part of the anodic chambers 2 to a degassing chamber 7 sited above the cell 1. The degassing chamber 7 is in communication, at its upper part, via a pipe 8, with a chlorine collector 9. A pipe 10 connects its lower part to the pipe 5. A pipe 16 emerges in the degassing chamber at a level 17 situated between those where the pipe 8 and the pipe 10 respectively emerge in the degassing chamber. It is used for discharging electrolyte from the degassing chamber when the electrolyte reaches the level 17.

As will emerge from the description which follows, the pipe 10 is used as the recycling pipe for the anolyte from the degassing chamber 7 to the entry pipe 5. It comprises a valve 11 which has the function of being open during normal operation of the cell and closed in the event of an electrolysis stoppage. To this end, the valve 11 is designed such that it is open in the case where the difference in pressures in the pipe 10, between the points A and B situated respectively upstream and downstream of the valve 11, is positive and such that it is closed when this difference is negative. Embodiments of the valve 11 are shown schematically in FIGS. 2, 3 and 4 which will be commented upon later.

As a variant, the pipe 10 can also include an adjusting tap 19 intended to adjust the electrolyte flow rate in the recycling pipe 10 when the valve 11 is in the open position.

During operation of the cell represented in FIG. 1, a substantially saturated aqueous sodium chloride solution is circulated in the entry pipe 5 and thus enters the anodic chambers 2. Simultaneously, a dilute aqueous sodium hydroxide solution is introduced into the cathodic chambers 3. Under the effect of the electric current, the aqueous solutions are electrolysed in the electrolysis chambers, so that chlorine is generated in the anodic chambers 2 and hydrogen is generated in the cathodic chambers 3. These gases subject the electrolytes to an upward movement in the electrolysis chambers. An emulsion of chlorine in a dilute aqueous sodium chloride solution thus enters the degassing chamber 7. The emulsion is broken up in the latter and the chlorine escapes into the collector 9 via the pipe 8. A fraction of the dilute aqueous sodium chloride solution rejoins the pipe 5 via the pipe 10, the valve 11 of which is open (as a result of the pressure in the upstream region A being greater than the pressure in the downstream region B) and the balance of the dilute solution leaves the degassing chamber via the pipe 16 at the level 17. In an analogous way, there is collected from the cathodic chambers 3, on the one hand hydrogen, and on the other hand, a concentrated aqueous sodium hydroxide solution.

In the event of a stoppage in the electrical supply, the anodic chambers are no longer the site of a gaseous chlorine generation, so that the difference in hydrostatic pressures between the regions A and B of the pipe 10 becomes approximately zero, resulting in the closure of the valve 11 which thus blocks the pipe 10. The shutting of the recycling pipe 10 prevents the stream of fresh electrolyte coming from the pipe 5 from rising via the pipe 10 and escaping via the pipe 16, by bypassing the anodic chambers 2; it thus has the immediate result of sweeping the anodic chambers 2 with an upward stream of fresh electrolyte coming from the pipe 5. The electrolyte which leaves the anodic chambers 2 passes through the degassing chamber 7 from where it escapes via the pipe 16.

Figure 2:
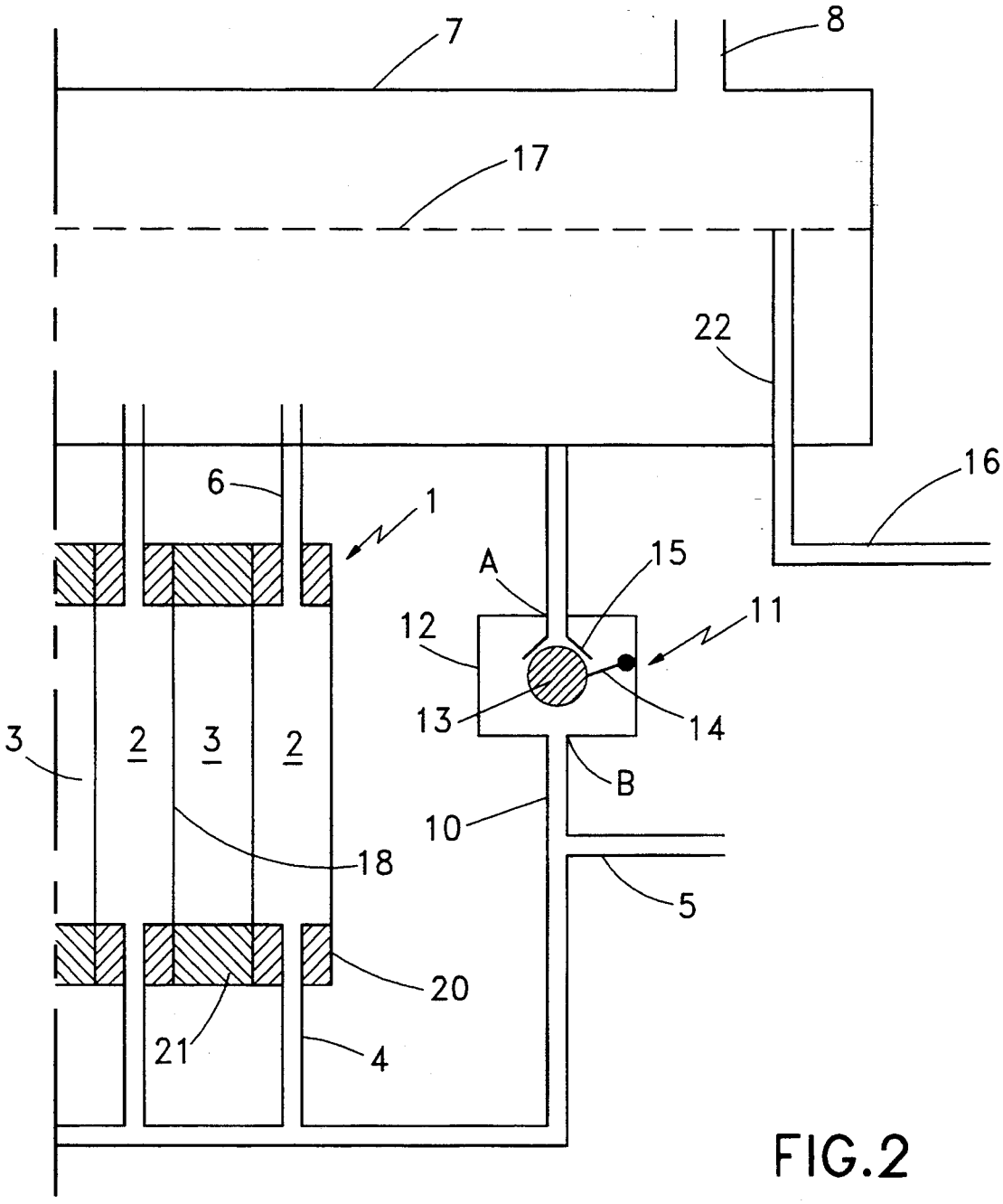
FIG. 2 is a partial view, in longitudinal elevation, of a particular embodiment of the cell according to the invention.

FIG. 2 shows, on a larger scale, a particular embodiment of a cell according to the invention. In the cell of FIG. 2, vertical frames 20 and 21 adjoining the membranes 18 define the anodic chambers 2 and the cathodic chambers 3 respectively. The pipeworks 4 and 6 pass through the frames 20 and put the anodic chambers 2 into communication with the entry pipe 5 and with the degassing chamber 7 respectively. Moreover, the electrolyte discharge pipe 16 comprises a vertical tube 22 which passes through the base of the chamber 7 and emerges into the latter at the level 17. The valve 11 comprises a case 12 in which a float 13, mounted on an articulation 14 which is integral with the case 12, can oscillate between a rest position, visible in FIG. 2, and a high position against a seat 15. In the latter position, the float 13 shuts the pipe 10, whereas in the rest position represented in FIG. 2, it allows the electrolyte to pass through the valve 11. The float is made of a material whose density is less than that of the electrolyte which flows in the pipe 10 during the operation of the cell.

During normal operation of the cell of FIG. 2, the pressure at A is greater than the pressure at B and is sufficient to drive back the float 13 and to separate it from its seat 15, so that the valve 11 is open. In the event of an electrolysis stoppage, the difference in pressures between the regions A and B becomes negligible so that the float 13 is driven back against its seat 15 and closes the valve 11.

Figure 3:
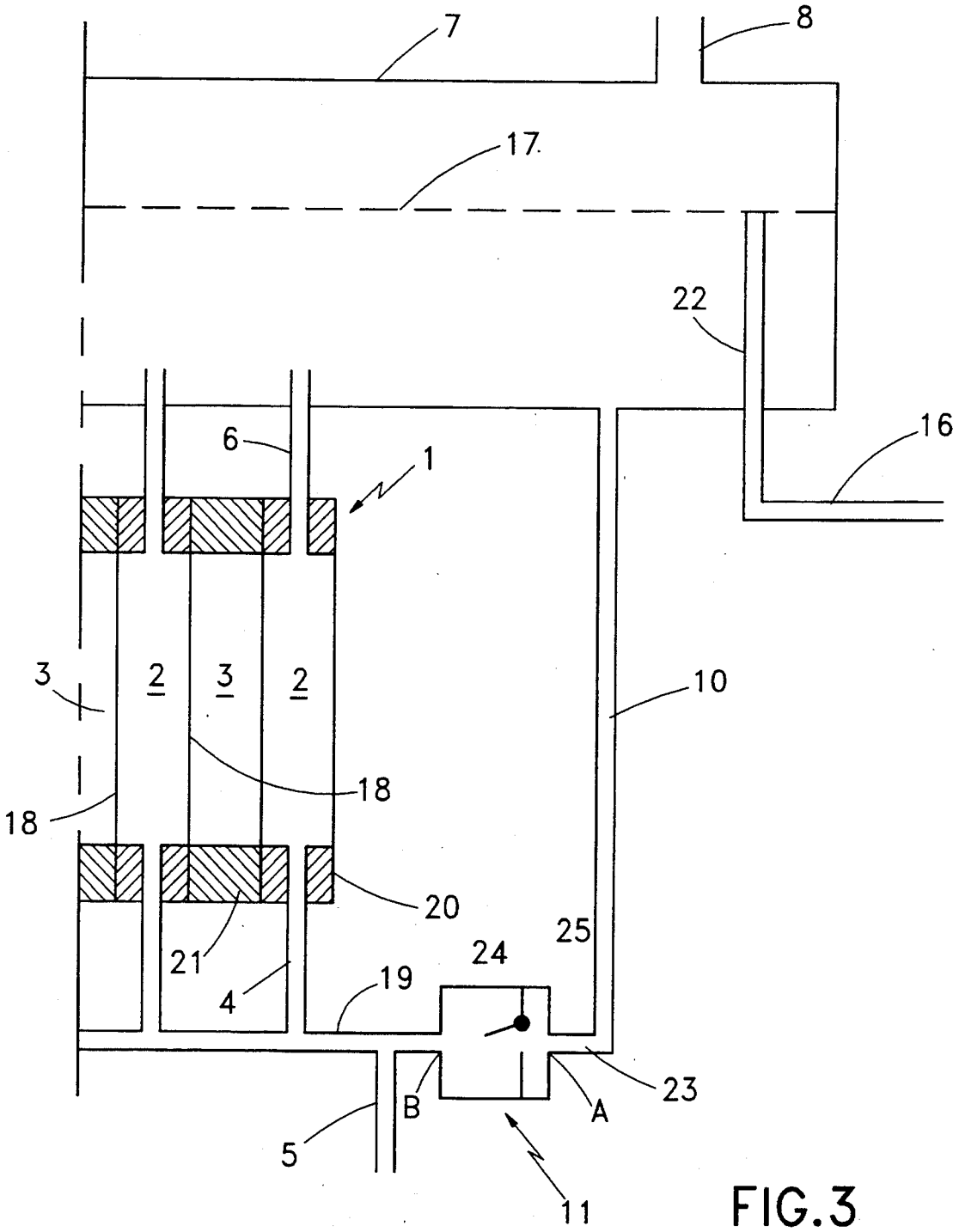
FIGS. 3 and 4 are views analogous to FIG. 2, of two other embodiments of the cell according to the invention.

In the cell of FIG. 3, the valve 11 is mounted in a horizontal section 23 of the pipe 10 and comprises a flap valve 24 which oscillates on a horizontal shaft 25.

During normal operation of the cell of FIG. 3, the pressure at A is greater than the pressure at B and is sufficient to move the flap valve 24 away from its vertical position, so that the valve 11 is open. In the event of an electrolysis stoppage, the difference in pressures between the regions A and B becomes negligible so that the flap valve falls back against its seat under the effect of its own weight and shuts the valve 11.

The cell of FIG. 4 differs from the cells of FIGS. 2 and 3 in that the pipework 6 emerges in the chamber 7 above the level 17 but below the level of the opening 8. The valve 11 comprises a case 26 in which a lift valve 27 is free to move between its seat 28 and a stop 29.

Figure 4:
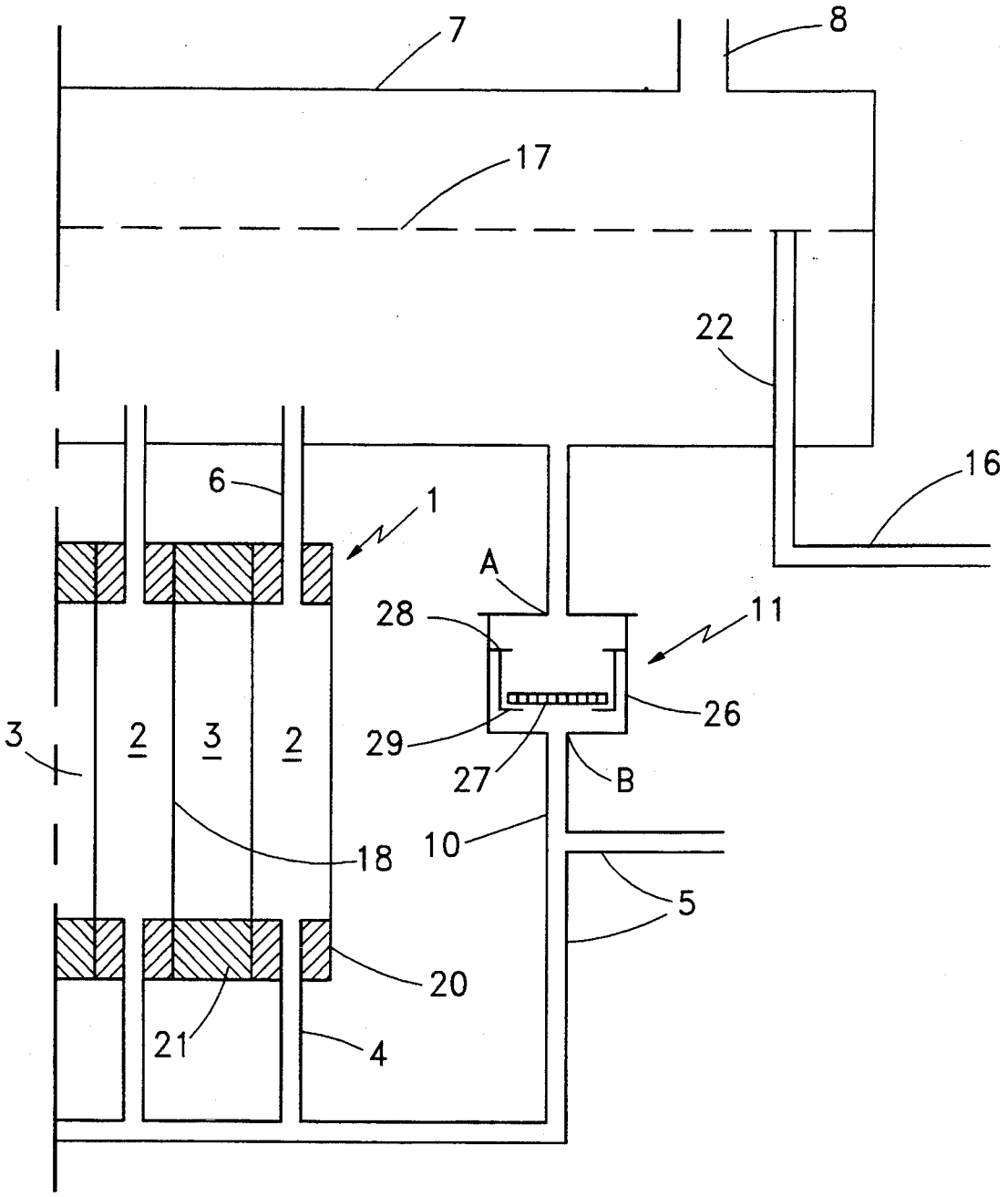

During normal operation of the cell of FIG. 4, the pressure at A is greater than the pressure at B so that the lift valve 27 rests on the stop 29 and opens the valve 11. In the event of an electrolysis stoppage, the pressure at B rapidly becomes greater than the pressure at A which results in the lift valve 27 being driven back against its seat 28 and shutting the valve 11.

I claim:

1. An electrolysis cell for the production of a gas comprising:

at least two separate electrolysis chambers respectively anodic and cathodic;

an electrolyte entry pipe in communication with a lower part of one of said electrolysis chambers adjacent a bottom thereof, said lower part being disposed below a midpoint of the height of the electrolysis chambers;

an electrolyte degassing chamber disposed at a higher level than said one of said electrolysis chambers and having a gas discharge opening and an electrolyte discharge opening;

means for providing communication between and upper part adjacent a top thereof of said one of said electrolysis chambers and said electrolyte degassing chamber, said upper part being disposed above the midpoint of the height of the electrolysis chambers;

an electrolyte recycling pipe connecting said degassing chamber to said electrolyte entry pipe in communication with said lower part of said one of said electrolysis chambers for recycling electrolyte from said degassing chamber to said one of said electrolysis chambers through said electrolyte entry pipe;

an automatic check valve in said electrolyte recycling pipe having a valve element operable in response to loss of electrolysis current automatically to an open position and a closed position for opening and closing of said check valve for controlling recycling of electrolyte from said degassing chamber to said one of said electrolyte chambers in dependence upon whether electrolyte pressure downstream of said check valve is respectively less than or greater than electrolyte pressure upstream of said valve; and whereby when said check valve in the recycling pipe is automatically closed in response to loss of electrolysis current a flow of fresh electrolyte flows into said one of said electrolysis chambers and fills the last-mentioned chamber with fresh electrolyte replacing electrolyte therein.

2. An electrolysis cell for the production of a gas according to claim 1, in which said electrolyte recycling pipe has a length thereof substantially vertically disposed, and in which said valve element moves upwardly for closing the check valve when said electrolyte pressure is less upstream of said check valve than downstream thereof and moves downwardly for opening said check valve when said electrolyte pressure is greater upstream of said check valve than downstream of said check valve.

3. An electrolysis cell for the production of a gas according to claim 1, in which said electrolyte recycling pipe has a length horizontally disposed, and in which said check valve is a flap valve having said valve element pivotally displaced about a horizontal pivot axis for closing the check valve when said electrolyte pressure is greater downstream of said check valve than upstream of said check valve, and said valve element pivots to a position opening said check valve when said pressure is greater upstream of said check valve than electrolyte pressure downstream of said check valve.

4. An electrolysis cell for the production of a gas according to claim 1, in which said check valve is a float valve having a float of less density than that of said electrolyte, and in which said float moves to a position for closing the check valve in response to electrolyte pressure greater downstream of said check valve than pressure upstream of said check valve, said float moves to a position for opening the check valve in response to electrolyte pressure downstream less than electrolyte pressure upstream of said check valve.

5. An electrolytic cell for the production of a gas according to claim 1, in which said electrolyte discharge opening is disposed at a level lower than said gas discharge opening, and is disposed higher than said electrolyte recycling pipe.

6. An electrolysis cell for the production of a gas according to claim 1, in which said means for providing communication between an upper part of said one of said electrolysis chambers and said electrolyte degassing chamber comprises a pipe connected to the degassing chamber at a level below a level of said electrolyte discharge opening and said gas discharge opening.

7. An electrolysis cell for the production of a gas according to claim 1, including an ion separator separating the anodic chamber from the cathodic chamber.

8. An electrolysis cell for the production of a gas according to claim 1 including, a plurality of separate anodic chambers alternating with separate cathodic chambers, ion separators separating said anodic and cathodic chambers, said anodic chambers or said cathodic chambers being connected in parallel to said degassing chamber, and those chambers connected to said degassing chamber being connected in parallel to said electrolyte entry pipe.

9. An electrolysis cell according to claim 1, including a membrane selectively permeable to cations separates said chambers.

10. An electrolysis cell for the production of a gas according to claim 1, including a plurality of separate anodic chambers alternating with separate cathodic chambers, membranes each selectively permeable to cations separating said chambers from each other, said anodic chambers or said cathodic chambers being connected in parallel to said degassing chamber, and those chambers connected to said degassing chamber being connected in parallel to said electrolyte entry pipe.

11. An electrolysis cell for the production of gas according to claim 1, in which said one of said electrolysis chambers is the anodic chamber fed with an aqueous alkali metal chloride solution.

12. An electrolysis cell for the production of gas according to claim 1, in which said check valve is a one-way check valve.

* * * * *